United States Patent [19]

Davanture

[11] 4,454,694

[45] Jun. 19, 1984

[54] PROTECTIVE ENCLOSURE FOR A STATIONARY OR MOVABLE MACHINE

[76] Inventor: Robert Davanture, 7 Clos Savaron, 69004 Lyon, France

[21] Appl. No.: 225,807

[22] Filed: Jan. 16, 1981

[30] Foreign Application Priority Data

Jan. 23, 1980 [FR] France ..... 80 01700

[51] Int. Cl.[3] ..... E04B 1/82

[52] U.S. Cl. ..... 52/270; 52/285; 52/809; 52/585; 52/582

[58] Field of Search ..... 52/262, 270, 271, 406, 52/582, 284, 285, 584, 809, 585, 404

[56] References Cited

U.S. PATENT DOCUMENTS

| | | | |
|---|---|---|---|
| 2,368,523 | 1/1945 | Cowhorne | 52/293 |
| 2,746,115 | 5/1956 | Mazzel | 24/610 |
| 2,815,997 | 12/1957 | Korb | 52/584 |
| 3,007,597 | 11/1961 | Morrison | 220/4 F |
| 3,093,259 | 6/1963 | Morrison | 220/4 F |
| 3,322,879 | 5/1967 | Lindgren | 52/809 |
| 3,343,314 | 9/1967 | Smith | 52/809 |
| 3,566,554 | 3/1971 | Schaffer | 52/79.5 |
| 3,885,362 | 5/1975 | Pollock | 52/126.7 |
| 3,899,043 | 7/1974 | Hall | 181/200 |
| 4,100,709 | 7/1978 | Good | 52/285 |
| 4,120,376 | 10/1978 | Palmer | 181/204 |
| 4,258,511 | 3/1981 | Strain | 52/270 |

FOREIGN PATENT DOCUMENTS

| | | |
|---|---|---|
| 749182 | 4/1953 | Fed. Rep. of Germany . |
| 915662 | 7/1946 | France . |
| 1502116 | 10/1967 | France . |
| 2166810 | 7/1973 | France . |

OTHER PUBLICATIONS

1978 Sweet's Catalog File, ©1978, Sweet's Division, Wenger Sound Module Rooms (pp. 13, 18/we, 4–8).

1978 Sweet's Catalog File, ©1978 Sweet's Division, Tracoustics Audiometric Exam. Rooms (pp. 13, 18/Tr, 1–3).

*Primary Examiner*—John E. Murtagh
*Assistant Examiner*—Kathryn Ford
*Attorney, Agent, or Firm*—Sandler & Greenblum

[57] ABSTRACT

The protective enclosure is of the type composed of several panels of square or rectangular shape removably assembled to one another. Each panel is generally constituted by a sheet-metal plate whose edges are folded so as to form a stiffening frame bordering the inner surface of the panel and defining, on the side of said inner surface, a space adapted to receive a thermally and/or acoustically insulating material. Each said panel is equipped, on at least three of its edges, with means enabling it to form a rigid assembly with adjacent panels, and ensuring, simultaneously their tightening, their alignment and/or their squaring.

9 Claims, 11 Drawing Figures

PROTECTIVE ENCLOSURE FOR A STATIONARY OR MOVABLE MACHINE

BACKGROUND OF THE INVENTION

1. Field of the Invention

The present invention relates to a protective and/or insulating enclosure for machines such as electricity generating units, compressors, measuring or laboratory machines and the like.

This type of enclosure is intended to ensure the protection of the machine that it covers. It can protect it against temperature changes. It can also protect the environment of the machine from noises possibly emitted by the latter by providing for its sound insulation.

2. Description of the Prior Art

As is shown in U.S. Pat. Nos. 3,885,362 and 4,120,376, these enclosures are generally constituted by square or rectangular panels removably assembled on frameworks or rib members which surround the machine concerned, each panel being itself, and generally, constituted by a plate whose edges are folded so as to form a stiffening frame bordering the inner surface of the panel and defining, on the side of its inner surface, a space adapted to receive a heat and/or sound insulating material.

These enclosures are hence complex, of high cost price and slow and laborious to dismantle.

It is an object of the present invention to overcome these drawbacks.

It is another object of the invention to provide an enclosure which resolves the problem consisting of eliminating any armature or intermediate structure, as well as doors for access to the enclosed equipment, by means of a novel design of the means for assembling the panels together by their judicious positioning.

It is a further object of the invention, to provide a protective enclosure, comprising assembly means according to the invention, which ensure in fact only the tightening, the alignment and the squaring of the panels and provide them with self-rigidity, whilst enabling their rapid dismantling from the outside.

Other objects and advantages will be apparent from the detailed description which follows.

SUMMARY OF THE INVENTION

According to the invention there is provided a protective enclosure for a stationary and/or movable machine, of the type only composed of several panels of square or rectangular shape assembled removably to one another, each panel being generally constituted by a sheet metal plate whose edges are folded so as to form a stiffening frame bordering the inner edge of the panel and defining, on the side of its inner surface, a space adapted to receive a thermally, and/or acoustically insulating material, characterised in that each panel is equipped, on at least three of its edges, with means enabling its rigid assembly with adjacent panels, whilst ensuring, simultaneously their tightening, their alignment and/or their squaring.

In any case, the invention will be well understood by means of the description which follows with reference to the accompanying diagrammatic drawings, showing by way of non-limiting examples, some preferred embodiments of the invention.

DESCRIPTION OF PREFERRED EMBODIMENTS

Figure 1:
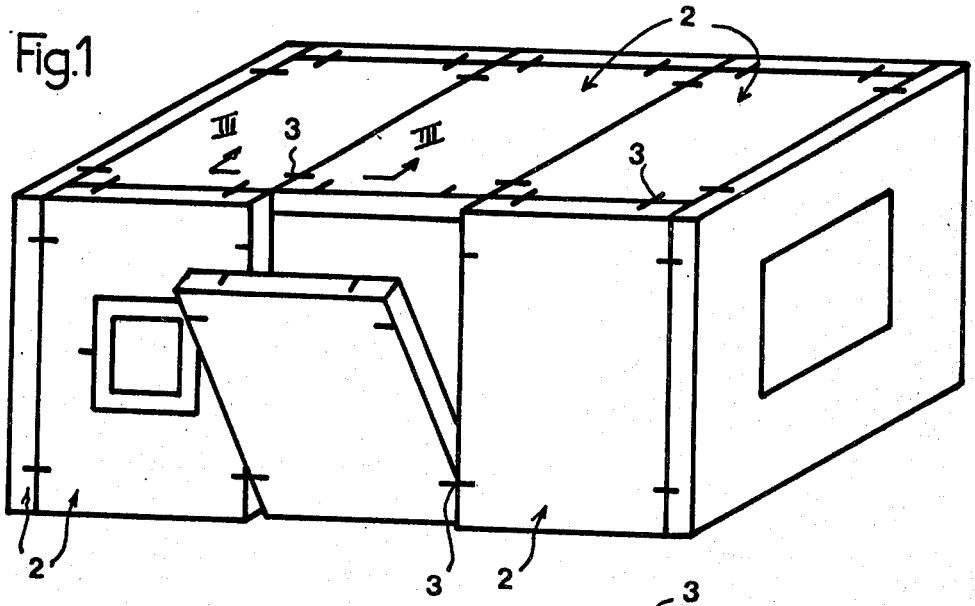
FIG. 1 is a general perspective view of an embodiment of an enclosure according to the invention.

As is shown in FIG. 1, the enclosure according to the invention is of the type composed of a plurality of panels of rectangular shape and rigidly assembled to one another.

Figure 2:
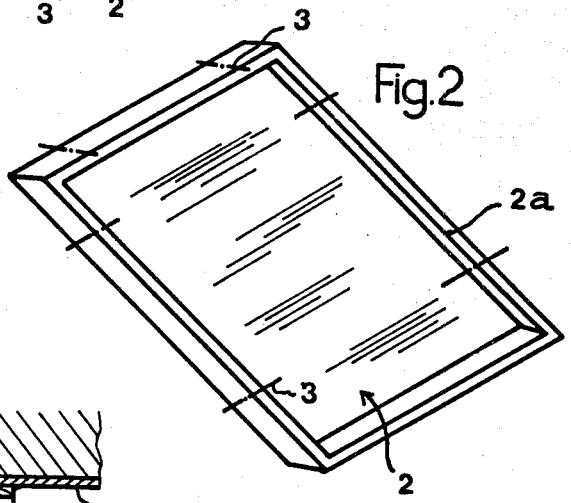
FIG. 2 is a perspective view of a panel of the embodiment of FIG. 1.

As is seen in FIG. 2, each panel 2 is of the type generally constructed from a plate whose edge is folded twice at right angles on its rear surface so as to form a frame **2*a*** having, on the one hand, the effect of ensuring the rigidity of the panel and on the other hand, of contributing to the formation of a housing adapted to receive a heat and/or sound insulating material when the enclosure concerned must ensure not only the protection of the machine that it covers, but its thermal and/or acoustic insulation.

As is seen in FIG. 1, all the panels 2 are assembled to one another either in extension of one another when they belong to the same wall, or corner-wise when they belong to two walls perpendicular to one another in the enclosure.

In the embodiment illustrated in the drawing, the walls at the end of the enclosure are formed by means of a single panel 2, whilst its side walls and its top wall each comprise three panels 2.

According to the invention, the assembly means 3 and the panels 2 are intended, not only to ensure the rigidity of the assembly but also the tightening, the alignment and/or the squaring up between adjacent panels.

These assembly means 3 therefore have the purpose of ensuring besides the alignment and/or the squaring of two adjacent panels, the tightening of their assembly edges, whether it involves two narrow edges or abutment surfaces of two panels end to end or whether it involves the narrow abutment edge of one panel and the rear surface of the frame 2*a* of the other panel in the case where two panels are assembled as a corner.

The means for assembly edge to edge of two adjacent panels 2 are borne, as shown in the drawing, by the outer surface of the panel concerned along its assembly edge.

In the embodiment illustrated in the drawing, each assembly edge of a panel 2 is equipped with two assembly means 3.

FIGS. 3 to 8 illustrate various embodiments of assembly means 3 for two panels 2 end to end.

Figure 3:
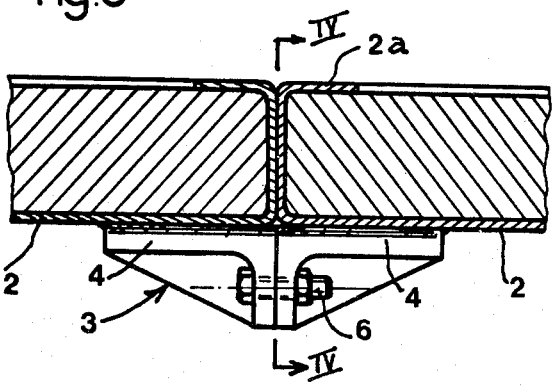
FIG. 3 is a partial view in section along the line III—III of FIG. 1 illustrating a first embodiment of an assembly means.
Figure 4:
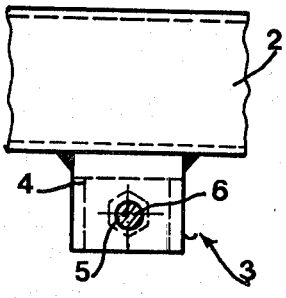
FIG. 4 is a sectional view along the line IV—IV of the embodiment of FIG. 3.

In the example illustrated in FIGS. 3 and 4, these assembly means are constituted by two brackets 4 each of which is fixed, through one of its wings, by welding or any other suitable manner, against the outer surface close to the assembly edge concerned and so that its other free wing is parallel to the plane of the narrow abutment surface of the edge concerned. The free wing of each bracket 4 is pierced by a hole 5 for the passage of an assembly bolt 6 which naturally traverses the holes 5 of the free wings of the two brackets 4 corresponding in the assembly concerned.

To obtain correct squaring and/or alignment, the brackets 4 must be fixed to the panels 2 accurately and so that the assembly surface of their two free wings is positioned strictly in the plane of the assembly surface of the panel concerned, whether it relates to the narrow abutment surface of the edge of this panel as in the example illustrated in the FIG. 3 or to the inner surface of its frame, in the case of a corner assembly as illustrated in FIG. 3.

Figure 5:
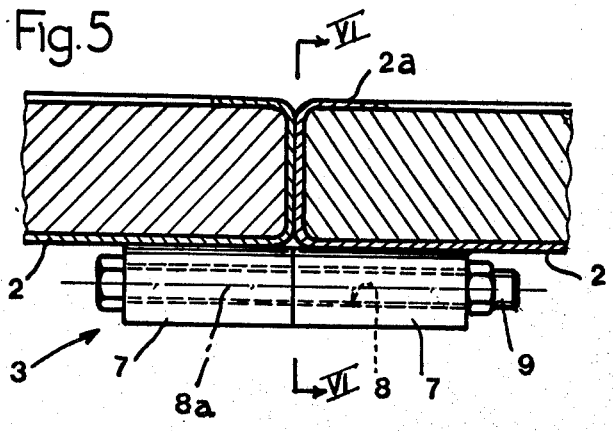
FIG. 5 is a similar view to that of FIG. 3 illustrating another embodiment of the assembly means.
Figure 6:
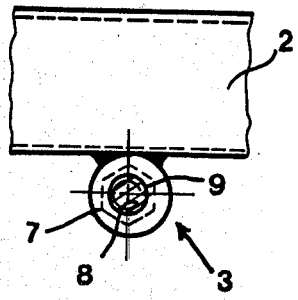
FIG. 6 is a sectional view along the line VI—VI of FIG. 5.

In the embodiment illustrated in FIGS. 5 and 6, each bracket is replaced by a cylindrical sleeve 7 also fixed to the outer surface of the panel concerned by welding, gluing or in any other suitable manner and so that the axis 8*a* of its bore 8 is perpendicular to the assembly plane, that is to say perpendicular to the plane of the narrow supporting edge surface corresponding to the edge concerned of the panel. In the preceding example, the assembly end of the sleeve 7 is located strictly in the plane of the assembly surface of the panel concerned.

As in the preceding example, the assembly may be held by means of a bolt 9 passing through the coaxial bores 8 of the corresponding sleeves 7 of two adjacent panels.

Figure 7:
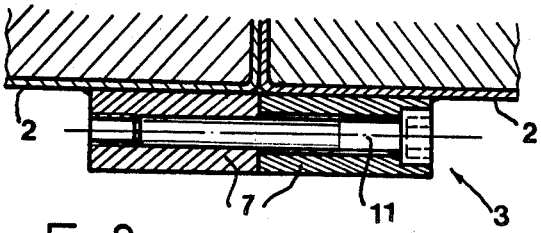
FIG. 7 is a view similar to that of FIG. 5 illustrating an improved embodiment of the assembly means of FIG. 5.

FIG. 7 illustrates a modification of the assembly means of FIGS. 5 and 6, according to which modification one of the sleeves 7 is tapped so as to enable the assembly of two corresponding sleeves 7 of two adjacent panels by means of a single screw 11 with the same thread as the aforesaid tapping.

In the same way, it could be arranged for the hole 5 of the free wing of one of the corresponding brackets in an assembly, to be tapped to permit said assembling by means of a single screw.

Naturally, on the same panel, one half of the bracket sleeve 7 or holes 5 will be tapped, since to one tapped sleeve 7 or one tapped hole 5 must correspond one smooth sleeve or one smooth hole.

Figure 8:
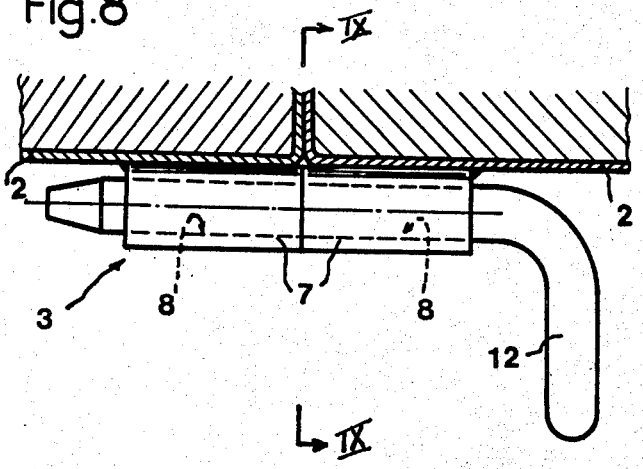
FIG. 8 is a view similar to those of FIGS. 3, 5, and 7, illustrating yet another embodiment of the assembly means.
Figure 9:
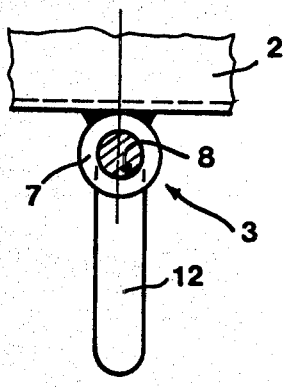
FIG. 9 is a sectional view along the line IX—IX of FIG. 8.

FIG. 8 illustrates yet another embodiment of the assembly means 3, according to which the bores 8 of the two sleeves 7 corresponding in an assembly are smooth, the fastening being maintained by means of an easily removable pin 12.

As is seen in FIG. 1, the assembly means 3 of opposite edges of a same panel are advantageously arranged coaxially so as to be able if necessary to serve as a pivoting axle for a panel after withdrawal of the other assembly means from said panel, as is illustrated in FIG. 1. In this way the simple and easy formation of a door in the protective enclosure is realised, the rigidity of the enclosure being ensured by the assembly of the other panels.

Figure 10:
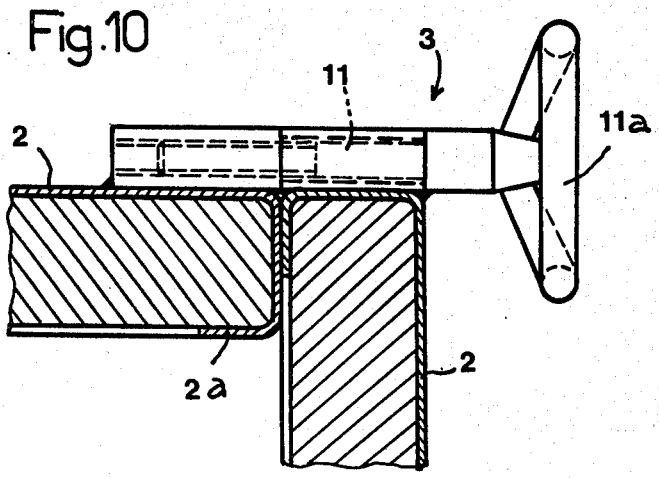
FIG. 10 is a view similar to those of FIGS. 3, 5, and 7, illustrating an embodiment of an assembly of two panels as a corner.

FIG. 10 shows an advantageous embodiment of certain assembly means 3 of a panel 2 having to constitute a door. In effect, these assembly means conform with those illustrated by FIG. 7 but in addition, the assembly screw 11 is provided with a manipulating wing 11*a*. It is thus easy and rapid to open and close the door constituted by the panel equipped with such means.

Figure 11:
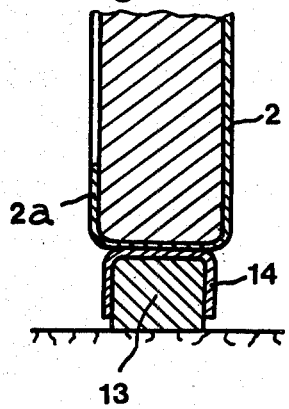
FIG. 11 is a partial view in section of a panel of an assembly according to the invention supported on the floor through one of its narrow edges.

As is shown in FIG. 11, in the case where a panel 2 is intended to be supported on the floor, its lower narrow supporting edge surface is advantageously equipped with seal 13 of flexible and elastic material, which has the effect of absorbing unevenness in the floor and or thus contributing to the maintenance of a seal in spite of these unevenesses.

In the embodiment illustrated in FIG. 11, the seal 13 is held by means of an angle member 14 of U-shaped cross-section, fixed through its web against the lower narrow supporting edge surface of the panel 2 concerned.

As is self-evident, and as emerges from the foregoing, the invention is in no way limited to only the embodiments of the assembly means of the panels of the enclosure which have been described above by way of non-limiting examples; it encompasses, on the contrary, all modifications. In fact, these assembly means can also be constituted by instantaneous dismantling devices such as, for example, but not exclusively, pins and clips. On the other hand, certain assembly means may be off-set in front of the edges of the vertical panels to facilitate manoeuvring at the ground of the lower edge of said panels to permit their swinging as shown in FIG. 1. In addition, the assembly means may be provided on panels of metal, plastic, wood or of any other suitable material.

The application of the assembly means which have just been described, may be contemplated for the production of protective enclosures designed for all types of machinery, whether stationary and/or movable.

I claim:

1. A protective enclosure for a machine or the like, said enclosure comprising a series of wall panels and a roof comprising roof panels, said wall and roof panels being separably and rigidly connected to each other without additional rigidifying members connecting more than two of said panels, each of said wall and roof panels comprising means for connecting adjacent wall and roof panels, said connecting means being located on the outside of each of said wall and roof panels when assembled into a rigid enclosure, said connecting means permitting rapid assembly and disassembly of said enclosure; wherein said wall and roof panels are individually removable; whereby ready access can be gained to any part of said enclosure by removal of a single wall or roof panel, said enclosure obviating a separate and distinct door and the removal of said roof for access into said enclosure; each of said panels comprising a plate with folded edges, said edges defining a recess receiving insulated material, said recess being located on the inner surface of each of said panels when said enclosure is assembled; and means for assembling at least two panels perpendicularly with respect to each other, said assembling means comprising at least one sleeve attached to one of said at least two panels, said sleeve having a bore, the axis of said bore being oriented perpendicularly to the plane of said one panel, said bore being attached to an outside surface of said one panel.

2. The protective enclosure according to claim 1 wherein said recess receives thermally insulating material.

3. The protective enclosure according to claim 1 wherein said recess receives acoustically insulating material.

4. The protective enclosure according to claim 1 further comprising a second sleeve on end of the other of said at least two panels, said second sleeve having a bore aligned with the bore of said one sleeve, said bores comprising means for receiving an assembly bolt.

5. The invention according to claim 1 wherein the lower edge of each of said panels comprises a profile rod of inverted U-shaped cross-section adapted to receive and partly house a flexible and elastic sealing element.

6. The protective enclosure according to claim 1 wherein said connecting means includes bores comprising means for receiving an assembly bolt.

7. A protective enclosure for a machine or the like, said enclosure comprising a series of wall panels and a roof comprising roof panels, said wall and roof panels being separably and rigidly connected to each other without additional rigidifying members connecting more than two of said panels, each of said wall and roof panels comprising means for connecting adjacent wall and roof panels, said connecting means being located on the outside of each of said wall and roof panels when assembled into a rigid enclosure, said connecting means permitting rapid assembly and disassembly of said enclosure; wherein said wall and roof panels are individually removable; whereby ready access can be gained to any part of said enclosure by removal of a single wall or roof panel, said enclosure obviating a separate and distinct door and the removal of said roof for access into said enclosure; each of said panels comprising a plate with folded edges, said edges defining a recess receiving insulated material, said recess being located on the inner surface of each of said panels when said enclosure is assembled; said connecting means including bores comprising means for receiving an assembly bolt; and said connecting means comprising sleeves each having a said bore therein.

8. The protective enclosure according to claim 7 wherein each said bore is adapted to fit a thread borne by said assembly bolt.

9. The protective enclosure according to claim 7 wherein said connecting means comprise brackets, said brackets having holes therein for the passage of an assembly bolt.

* * * * *